US007437807B2

(12) United States Patent
Gärtner et al.

(10) Patent No.: US 7,437,807 B2
(45) Date of Patent: Oct. 21, 2008

(54) TUFTED BACKING AND METHOD OF MANUFACTURING SAME

(75) Inventors: Rudolf Gärtner, Birkenau (DE); Peter Sander, Bruchmühlbach (DE); Detlef Barbier, Waldfischbach-Burgalben (DE); Ulrike Maaβ, Kaiserslautern (DE); Engelbert Löcher, Worms (DE); Ararad Emirze, Kaiserslautern (DE); Klaus Klein, Föckelberg (DE); Christine König, Rodenbach (DE)

(73) Assignee: Firma Carl Freusenberg KG, Weinham (DE)

( * ) Notice: Subject to any disclaimer, the term of this patent is extended or adjusted under 35 U.S.C. 154(b) by 159 days.

(21) Appl. No.: 10/074,404

(22) Filed: Feb. 12, 2002

(65) Prior Publication Data

US 2002/0127934 A1 Sep. 12, 2002

(30) Foreign Application Priority Data

Feb. 19, 2001 (DE) ..... 101 08 092

(51) Int. Cl.

| | |
|---|---|
| ***D04H 3/00*** | (2006.01) |
| ***D04H 3/08*** | (2006.01) |
| ***D04H 3/10*** | (2006.01) |
| ***D04H 3/14*** | (2006.01) |
| ***D06C 3/00*** | (2006.01) |

(52) U.S. Cl. ..... 28/112; 28/103; 28/104; 28/107; 28/111; 26/51

(58) Field of Classification Search ..... 28/103, 28/104, 107, 111, 112; 26/51–53
See application file for complete search history.

(56) References Cited

U.S. PATENT DOCUMENTS

| | | | | |
|---|---|---|---|---|
| 4,042,655 | A * | 8/1977 | Platt et al. | 264/492 |
| 4,105,381 | A * | 8/1978 | Platt et al. | 425/83.1 |
| 4,151,023 | A * | 4/1979 | Platt et al. | 156/62.2 |
| 4,497,097 | A * | 2/1985 | Schneider et al. | 28/112 |
| 4,879,170 | A * | 11/1989 | Radwanski et al. | 442/329 |
| 5,587,225 | A * | 12/1996 | Griesbach et al. | 428/198 |
| 5,657,520 | A * | 8/1997 | Greenway et al. | 26/51 |
| 5,730,821 | A | 3/1998 | Joest et al. | |
| 6,598,276 | B2 * | 7/2003 | Shepard et al. | 26/51 |
| 2004/0238105 | A1 * | 12/2004 | Schneider et al. | 156/179 |
| 2006/0175001 | A1 * | 8/2006 | Schneider et al. | 156/244.11 |
| 2007/0138698 | A1 * | 6/2007 | Gerndt et al. | 264/287 |

FOREIGN PATENT DOCUMENTS

| | | | |
|---|---|---|---|
| DE | 2900888 | | 7/1980 |
| DE | 94 11 993.7 | | 11/1994 |
| DE | 195 01 123 | | 7/1996 |
| DE | 195 01 125 | | 7/1996 |
| DE | 19821848 | | 11/1999 |
| EP | 0013355 | | 7/1980 |
| EP | 0 795 637 | | 9/1997 |
| EP | 0796940 | | 9/1997 |
| EP | 0900869 | | 10/1999 |
| GB | 1535988 | A * | 12/1978 |
| JP | 10-273865 | | 10/1998 |
| JP | 10-273873 | | 10/1998 |
| JP | 2000-273751 | | 10/2000 |
| WO | 96/29460 | | 9/1996 |
| WO | WO 00/65140 | | 11/2000 |

* cited by examiner

*Primary Examiner*—Cheryl Juska
(74) *Attorney, Agent, or Firm*—Kenyon & Kenyon LLP

(57) ABSTRACT

A tufted backing and a method of manufacturing a tufted backing from thermoplastic polymer fibers or filaments that are processed to yield a spunbonded nonwoven are described, the spunbonded nonwoven containing only fibers or filaments having a titer of 1 to 15 dtex, the mass per unit area of the tufted backing being 70 to 110 g/m$^2$, its density being 0.18 to 0.28 g/cm$^3$ and the 5% modulus value in the machine direction being >60 N/5 cm, but at least 0.6 Nm$^2$/g.

19 Claims, No Drawings

TUFTED BACKING AND METHOD OF MANUFACTURING SAME

BACKGROUND OF THE INVENTION

1. Field of the Invention

The invention relates to a tufted backing and a method of manufacturing a tufted backing from thermoplastic polymer fibers or filaments processed into a spunbonded nonwoven.

2. Description of Related Art

European Patent Application 79 56 37 A describes the use of nonwovens of polyester and copolyester fibers as a tufted backing for tufted carpets reinforced by parallel, straight, load-bearing continuous plastic fibers. Despite a mass per unit area of only 80 to 150 g/m$^2$, this measure should yield a tufted backing which is resistant to the effects of stress, temperature and moisture in dyeing, tufting and steaming during manufacture and processing to yield tufted carpets, in particular with regard to lateral shrinkage.

In addition, a nonwoven for coating carpet backings is known from German Utility Model 94 11 993, where the bonded elementary fiber nonwoven having a mass per unit area of 20 to 220 g/m$^2$ is reinforced by a maliwatt method with warp threads of film ribbons. This should improve foot comfort, the connection to the carpet weave, the shape of the carpet and its recyclability.

German Patent Application 195 01 123 and German Patent Application 195 01 125 describe a method which results in a greater strength of the nonwoven in both longitudinal and transverse directions due to a stretching operation in the stretch range of 100% to 400% and reduces both the elongation and the residual shrinkage. Preferably, however, the mass per unit area of the nonwoven webs is to be reduced at preselected values for their elongation and residual shrinkage. However, the stated degree of stretching in combination with the resulting stretching of the fibers themselves results in a significant restriction of the mobility of the fibers in the nonwoven, so that the tufting process is impaired.

Japanese Patent Application 10-273865 describes tufted backings made of continuous filaments of a thermoplastic synthetic resin and having a thermal shrinkage in transverse direction with dry heating in the range of −10% to 0%, measured according to JIS L 1906. The tufted backings are constructed of a high-melting component and a low-melting component.

International Patent 96/29460 describes tufted carpets composed of a tufted backing and an adhesive binder. The binder should preferably be a thermoplastic polymer which is applied to or bonded with the tufted backing.

SUMMARY OF THE INVENTION

It is an object of the invention to provide a tufted backing composed of a spunbonded nonwoven having low raw material costs without reinforcing yarns or scrims, the binding being accomplished without (costly) auxiliary components such as bonding fibers or binders. The tufted backing should also have a high dimensional stability in the tufting and dyeing operations and should ensure good carpet yarn tie up.

It is a further object of the invention to provide a method of manufacturing a tufted backing that will make inexpensive lightmass per unit area nonwovens having a mass per unit area of 70 to 110 g/m$^2$ available while simplifying the manufacturing operation and yielding an improved dimensional stability due to this method.

These and other objects of the invention are achieved by a tufted backing made of synthetic fibers or filaments interwoven in a three-dimensional structure, including only fibers or filaments having a titer of 1 to 15 dtex, i.e., the tufted backing is manufactured without additional binding components and is thus environmentally friendly. In addition, no reinforcing aids such as yarns or scrims are used. The mass per unit area of the tufted backing is 70 to 110 g/m$^2$, its density is 0.18 to 0.28 g/cm$^3$ and the 5% modulus value in the machine direction is >60 N/5 cm but at least 0.6 Nm$^2$/g. The tufted backing has dimensional stability in subsequent processing in the tufting and dyeing operations.

DETAILED DESCRIPTION OF THE INVENTION

The tufted backing is advantageously one in which the fibers or filaments have a titer of 3 to 12 dtex, and the 5% modulus value in the machine direction is 70 to 100 N/5 cm but at least 0.7 to 1.0 Nm$^2$/g.

In an advantageous embodiment of the present invention, the tufted backing is finished with finishing agents or surface-active substances. The finish facilitates introduction of the pile yarn in the tufting operation.

A tufted backing composed only of polyethylene terephthalate is especially preferred. Manufacture from a uniform material simplifies reusability.

A tufted backing made of polypropylene alone is likewise preferred. Such a tufted backing is recyclable.

The method according to the invention for manufacturing a tufted backing of thermoplastic polymer fibers or filaments processed into a spunbonded nonwoven is characterized in that the fibers or filaments having a titer of 6 to 15 dtex are bonded by needling and the fibers or filaments having a titer of 1 to 5 dtex are bonded by using water jets or by a combination of these methods, and before drying and thermosetting, they are stretched by up to 30% in the longitudinal direction, the mobility of the fibers optionally being improved by the addition of oil or some other finish.

The stretching operation is advantageously performed between the individual needling stages or after conclusion of the needling operation. The stretching is performed while the fibers are wet, cold, or heated with steam (100° C.).

To improve the modulus values, the surface bonding and the uniformity of thickness, partial compacting by embossing rollers may be performed after thermosetting, the embossing points of the embossing roller taking up a pressure area of 18% to 25% and forming a diamond, linear or hexagonal shape.

The embossing rollers may have an irregular surface structure with a roughness of 40 to 100 μm.

The tufted backing nonwovens manufactured according to the present invention have the following properties:

maximum shrinkage of 5% during manufacture of the carpet, and an initial modulus of 0.6 to 1.0 Nm$^2$/g.

The present invention is explained in greater detail by the following examples, which should be regarded in an illustrative, rather than a restrictive, sense.

EXAMPLE

Manufacturing Steps for a 90 g/m$^2$ 100% Polyethylene Terephthalate (PET) Spunbonded Nonwoven a) Semi-finished Material (Sheet Material)

PET fibers were spun out and laid on a screen belt to form a spunbonded nonwoven at a belt speed of 15 m/min, using a standard commercial PET raw material having a solution viscosity (intrinsic viscosity=IV value) of 0.67. The spun filaments have a titer of 4.3 dtex with strength and elongation values of 30 mN/dtex and 110%, respectively. The shrinkage of the filaments at the boil was less than 1%.

b) Prebonding

Prebonding of the area goods was performed by needling, with the needle penetration being 6 mm and the needle density being 60 E/cm$^2$. The 15×18×40 needles used were from the Groz Beckert Company.

c) Water Jet Bonding

The prebonded area goods were sent to a water jet system having five water jet crossbars. The looping and hooking of the filaments were performed as follows in the water pressure range of 20 to 150 bar.

Crossbar 1: 20 bar
Crossbar 2: 100 bar
Crossbar 3: 150 bar
Crossbar 4: 150 bar
Crossbar 5: 150 bar, with the nonwoven being treated with water jets alternately from the top and from the bottom.

d) Stretching

The stretching operation with the water jet-bonded product was performed in the gap between two rollers running with a speed difference of 15%. The sheet material was being passed around the pair of rollers with an S-wrap, the roller surface temperature being 150° C. Drying and thermosetting of the PET filaments were performed in a suction dryer at temperatures of 180° C.

e) Thermosetting

The thermoset sheet material was calandered with an embossing roller which produced a pressure area of 18% with 33 diamond-shaped embossing points per cm$^2$. The calandering surface temperature and the line pressure were 220° C. and 20 daN/cm, respectively.

f) Finishing

The finish was applied in a spray installation using a polydimethylsiloxane emulsion. The solids concentration and the wet uptake amounted to 1.9% and 11%, respectively.

The spunbonded nonwoven finished with the finishing agent was dried in a flat belt dryer at air temperatures of 110° C.

The spunbonded nonwoven produced by the steps described above and having a mass per unit area of 90 g/m$^2$ had the following physical values: thickness: 0.45 mm force at 5% elongation (longitudinal): 91 N/5 cm (specific modulus: 1 Nm$^2$/g force at 5% elongation (transverse): 40 N/5 cm.

This spunbonded nonwoven made of PET filaments could be tufted very well. At a gauge of 1/10, the following physical values were obtained:

maximum tensile force (longitudinal): 340 N/5 cm
maximum tensile force (transverse): 150 N/5 cm
elongation (longitudinal): 50%
elongation (transverse): 65%
tear propagation force (longitudinal): 210 N

What is claimed is:

1. A method of manufacturing a spunbonded nonwoven from thermoplastic polymer fibers or filaments, comprising the steps of (i) performing at least one of (a) bonding fibers or filaments having a titer of 6 to 15 dtex by needling, and (b) bonding fibers or filaments having a titer of 1 to 5 dtex by using a combination of water jets and needling, and (ii) stretching the bonded fibers or filaments by up to 30% in the longitudinal direction between needling stages by passing the bonded fibers between a pair of rollers running at different speeds in a S-wrap configuration, the spunbonded nonwoven exhibiting no more than 5% shrinkage during carpet manufacture using the spunbonded nonwoven.

2. The method according to claim 1, wherein a finishing agent is added to the fibers or filaments to improve mobility.

3. The method according to claim 1, further comprising an additional treatment performed with a pair of heated rollers.

4. The method according to claim 3, wherein surfaces of the rollers have an irregular structure having a surface roughness of 40 to 100 μm.

5. The method according to claim 3, wherein at least one of the rollers has an embossing, the embossing points covering a pressure area of 18% to 25% and forming one of diamond, linear and hexagonal shapes.

6. The method according to claim 4, wherein at least one of the rollers has an embossing, the embossing points covering a pressure area of 18% to 25% and forming one of diamond, linear and hexagonal shapes.

7. The method according to claim 2, wherein the spunbonded nonwoven has: a mass per unit area of 70 to 110 g/m$^2$, a density of 0.18 to 0.28 g/cm$^3$, and a 5% modulus value in the machine direction >60 N/5 cm.

8. The method according to claim 7, wherein the fibers or filaments have a 5% modulus value in the machine direction of 70 to 100 N/5 cm.

9. The method according to claim 1, wherein the spunbonded nonwoven is made only of polyethylene terephthalate and has: a mass per unit area of 70 to 110 g/m$^2$, a density of 0.18 to 0.28 g/cm$^3$, and a 5% modulus value in the machine direction >60 N/5 cm.

10. The method according to claim 9, wherein the fibers or filaments have a 5% modulus value in the machine direction of 70 to 100 N/5 cm.

11. The method according to claim 7, wherein the spunbonded nonwoven is made only of polyethylene terephthalate.

12. The method according to claim 1, wherein the spunbonded nonwoven is made only of polypropylene and has: a mass per unit area of 70 to 110 g/m$^2$, a density of 0.18 to 0.28 g/cm$^3$, and a 5% modulus value in the machine direction >60 N/5 cm.

13. The method according to claim 12, wherein the fibers or filaments have a 5% modulus value in the machine direction of 70 to 100 N/5 cm.

14. The method according to claim 7, wherein the spunbonded nonwoven is made only of polypropylene.

15. The method according to claim 2, wherein the finishing agent is oil.

16. The method according to claim 1, wherein the spunbonded nonwoven has a three-dimensional structure and a mass per unit area of 70 to 110 g/m$^2$, a density of 0.18 to 0.28 g/cm$^3$, and a 5% modulus value in the machine direction >60 N/5 cm.

17. The method according to claim 16, wherein the fibers or filaments have a 5% modulus value in the machine direction of 70 to 100 N/5 cm.

18. The method according to claim 16, wherein the spunbonded nonwoven is made only of polyethylene terephthalate.

19. The method according to claim 16, wherein the spunbonded nonwoven is made only of polypropylene.

* * * * *